United States Patent [19]

Pace

[11] 4,253,671

[45] Mar. 3, 1981

[54] POLE STRUCTURE FOR SUPPORTING A NET OF A FIELD GAME

[76] Inventor: R. B. Pace, 3461 Old Brandon Rd., Pearl, Miss. 39204

[21] Appl. No.: 86,658

[22] Filed: Oct. 22, 1979

[51] Int. Cl.[3] ..... A63B 61/04

[52] U.S. Cl. ..... 273/411; 273/29 BB

[58] Field of Search ..... 273/29 B, 29 BB, 29 BC, 273/411

[56] References Cited

U.S. PATENT DOCUMENTS

| | | | |
|---|---|---|---|
| 3,940,139 | 2/1976 | Barnes | 273/411 |
| 4,135,716 | 1/1979 | Ginsburg | 273/29 BC |

FOREIGN PATENT DOCUMENTS

| | | | |
|---|---|---|---|
| 207343 | 11/1923 | United Kingdom | 273/29 BB |

*Primary Examiner*—Anton O. Oechsle

*Attorney, Agent, or Firm*—Daniel Jay Tick

[57] ABSTRACT

A mounting device supports an elongated linearly extending member at its bottom end vertically in the ground. A length of chain has a bottom end coupled to the mounting device and a spaced opposite top end coupled to the member in the area of the top end of the member in a manner whereby the chain extends parallel with the member in spaced relation therewith. A tension adjusting device is coupled in the chain intermediate the ends in a manner whereby the chain functions as an adjustable strut to maintain the member in vertical position. A net supporting device supports a net in the area of the top end of the member and perpendicularly to the member, and includes a roller rotatably mounted on the member closely adjacent the top end thereof. A length of cord passes around part of the roller in a manner whereby a first part of the cord extends in spaced parallel relation with the member between the member and the chain and a second part of the cord extends perpendicularly with the member for supporting a net. A length of elastic material has a top end coupled to the first part of the cord and a spaced opposite bottom end coupled to the member in the area of the bottom end thereof whereby tension is maintained on a net supported by the cord and the net is lowerable along the member.

8 Claims, 3 Drawing Figures

FIG. 1
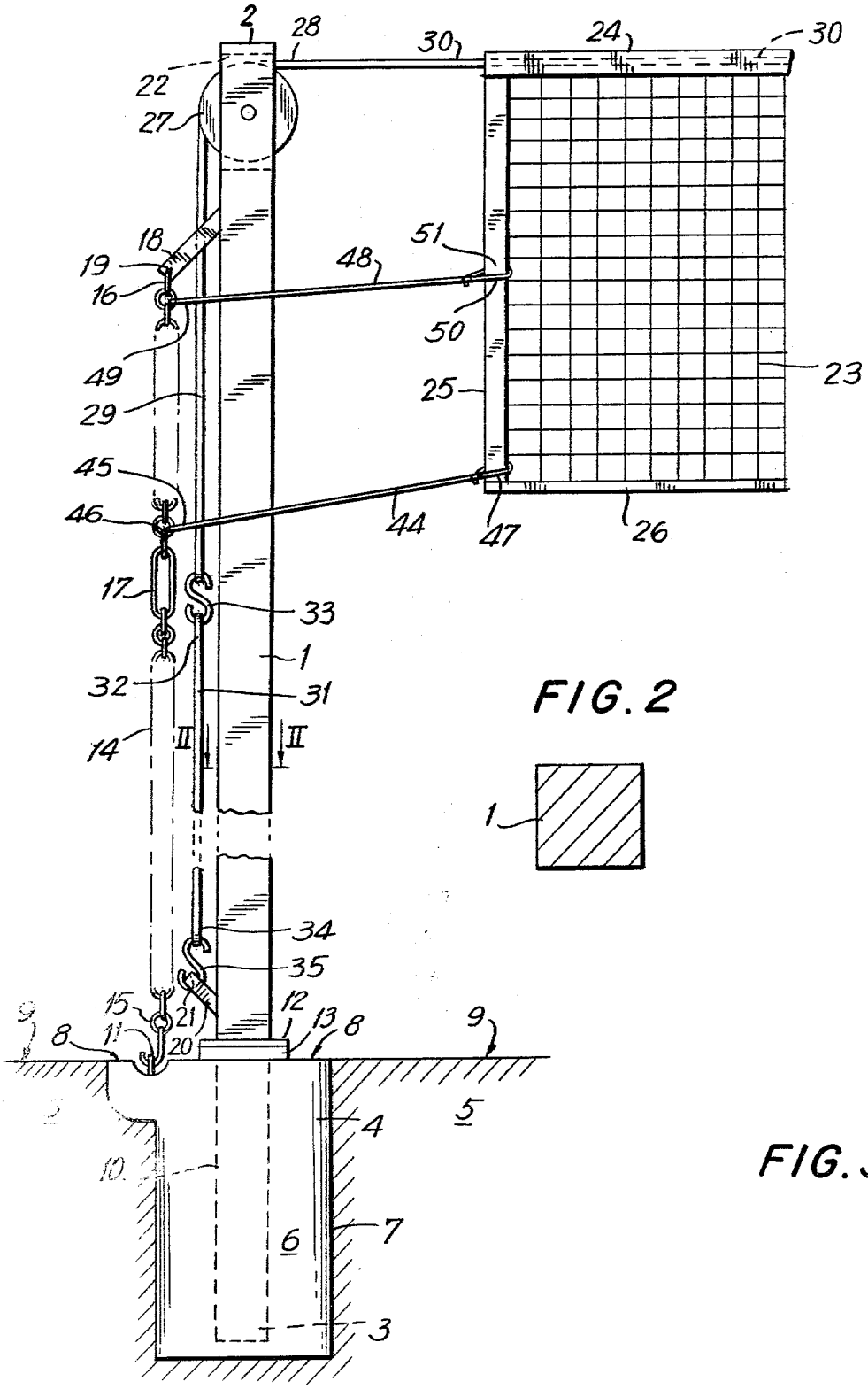
FIG. 2
FIG. 3
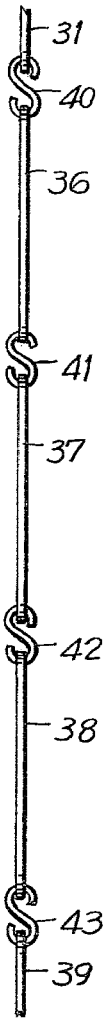

POLE STRUCTURE FOR SUPPORTING A NET OF A FIELD GAME

BACKGROUND OF THE INVENTION

The present invention relates to a pole. More particularly, the invention relates to a pole for supporting a net of a field game.

Several field games, including volleyball, use nets supported by, and extending between, a pair of upright poles. The different methods of supporting such poles in the ground are rather awkward and involve considerable work. They therefore result in the expenditure of considerable time and are therefore expensive in execution. Many of them involve maintaining the pole in upright position via a plurality of stakes driven into the ground and guy wires affixed to the pole and the stakes and extending therebetween. The guy wires and stakes create a dangerous situation, since the players may easily trip over them and suffer personal injury, as well as the loss of points in the game being played.

The principal object of the invention is to provide a pole of simple structure, which is inexpensive in manufacture and installation, for supporting a net of a field game.

An object of the invention is to provide a pole for supporting a net of a field game, which pole is installable with rapidity and inexpensively and maintains the net in a desired position.

Another object of the invention is to provide a pole of simple structure, which avoids the need for guy wires or stakes, and is installable with facility and convenience to support a net of a field game by anyone, however unskilled.

Still another object of the invention is to provide a pole, which is inexpensive in manufacture and in installation, and functions efficiently, effectively and reliably to support a net of a field game in desired adjustable positions.

Yet another object of the invention is to provide a pole, which is installable, without ground stakes or guy wires, with rapidity, facility and convenience by anyone, and extends upright from the ground, when installed, for supporting a net of a field game in an adjustable position.

BRIEF SUMMARY OF THE INVENTION

In accordance with the invention, a pole for supporting a net of a field game comprises an elongated substantially linearly extending member having spaced opposite top and bottom ends. A mounting device supports the elongated member at its bottom end substantially vertically in the ground. A length of chain has a bottom end coupled to the mounting device, a spaced opposite top end coupled to the elongated member in the area of the top end of the member in a manner whereby the length of chain extends substantially parallel with the member in spaced relation therewith and a tension adjusting device coupled therein intermediate the ends in a manner whereby the chain functions as an adjustable strut to maintain the member in substantially vertical position. A net supporting device supports a net in the area of the top end of the elongated member and substantially perpendicularly to the member. The net supporting device comprises a roller rotatably mounted on the member closely adjacent the top end thereof. A length of cord passes around part of the roller in a manner whereby a first part of the cord extends in spaced substantially parallel relation with the elongated member between the member and the length of chain and a second part of the cord extends substantially perpendicularly with the member for supporting a net at the top of the net. A length of elastic material has a top end coupled to the first part of the cord and a spaced opposite bottom end coupled to the elongated member in the area of the bottom end thereof whereby tension is maintained on a net supported by the cord and the net is lowerable along the elongated member.

The mounting device comprises a block seated in a hole in the ground having an upper surface substantially level with the surface of the ground. The block has a substantially vertically extending channel formed therethrough and accommodating the bottom end part of the elongated member. A hook device is mounted on the upper surface in spaced relation with the channel for releasably coupling the bottom end of the length of chain to the block.

An annular plate is provided around the elongated member in close proximity with the upper surface of the block. A collar of waterproof material is provided around the elongated member at the upper surface of the block and next-adjacent the plate and covers the channel thereby preventing liquid from entering the channel.

The tension adjusting device comprises a turnbuckle. An upper arm extends from the elongated member in the area of the top end thereof and has a free end spaced from the elongated member. The top end of the length of chain is coupled to the free end of the upper arm.

The elongated member has a substantially square cross-section. The channel of the block is of substantially square cross-section.

A lower arm extends from the elongated member in the area of the bottom end thereof and has a free end spaced from the elongated member. The bottom end of the length of elastic material is releasably coupled to the free end of the lower arm. The elongated member has a hole formed therethrough extending transversely thereof closely adjacent the top end thereof and the roller is rotatably mounted in the hole.

Additional lengths of elastic material are provided. A plurality of hook devices releasably couple the lengths of elastic material to form an elongated length of the material.

A second cord maintains a net in position. The second cord has a first end tied to the length of chain at a point between the ends thereof, and a second end for tying to the bottom of a net. A third cord maintains the net in position. The third cord has a first end tied to the length of chain near the top end thereof and a second end for tying to the net at a point intermediate the top and bottom thereof.

BRIEF DESCRIPTION OF THE DRAWINGS

In order that the invention may be readily carried into effect, it will now be described with reference to the accompanying drawings, wherein:

FIG. 1 is a view of an embodiment of the pole of the invention for supporting a net of a field game;

FIG. 2 is a cross-sectional view, on an enlarged scale, taken along the lines II—II, of FIG. 1; and FIG. 3 is a view of a preferred embodiment of the length of elastic material of the net supporting device of the pole of the invention.

DETAILED DESCRIPTION OF THE INVENTION

An elongated, linearly extending, member 1 (FIGS. 1 and 2) has spaced opposite top and bottom ends 2 and 3, respectively (FIG. 1). The member 1 is preferably of square cross-section as shown in FIG. 2.

A mounting device 4 supports the member 1 at its bottom end 3 substantially vertically in the ground 5 (FIG. 1). The mounting device 4, as shown in FIG. 1, comprises a block 6 seated in a hole 7 in the ground 5. The block 6 has an upper surface 8 substantially level with the surface 9 of the ground 5 (FIG. 1).

The block 6 has a vertically extending channel 10 formed therethrough, as shown in FIG. 1. The channel 10 is of square cross-section and accommodates the bottom end 3 part of the member 1. The block 6 also has a hook device 11 (FIG. 1) mounted on the upper surface 8 thereof in spaced relation with the channel 10.

An annular plate 12 is provided around the member 1 in close proximity with the upper surface 8 of the block 6 (FIG. 1). A collar 13 (FIG. 1) of waterproof material of any suitable type such as, for example, rubber, is mounted around the member 1 at the upper surface 8 of the block 6, next-adjacent the plate 12. The collar 13 covers the channel 10, as shown in FIG. 1, thereby preventing water and any other liquid from entering said channel.

A length of chain 14 has a bottom end 15 releasably coupled to the hook device 11 of the block 6, as shown in FIG. 1. The length of chain 14 has a spaced opposite top end 16 coupled to the member 1 in the area of the top end 2 of said member (FIG. 1) in a manner whereby the length of chain extends parallel with said member in spaced relation therewith, as shown in FIG. 1.

A tension adjusting device 17 is coupled in the chain 14 intermediate the ends 15 and 16 thereof (FIG. 1) in a manner whereby said chain functions as an adjustable strut to maintain the member 1 in a substantially vertical upright position. The tension adjusting device 17 preferably comprises a turnbuckle.

An upper arm 18 extends from the member 1 in the area of the top end 2 of said member and has a free end 19 spaced from said member, as shown in FIG. 1. The top end 16 of the length of chain 14 is coupled to the free end 19 of the upper arm 18 (FIG. 1). A lower arm 20 extends from the member 1 in the area of the bottom end 3 thereof, near the surface 9 of the ground 5, and has a free end 21 spaced from said member, as shown in FIG. 1.

The member 1 has a hole 22 formed therethrough, extending transversely thereof closely adjacent the top end 2 of said member, as shown in FIG. 1.

A net supporting device supports a net 23 (FIG. 1) in the area of the top end 2 of the member 1 and perpendicularly to said member, as shown in FIG. 1. The net 23 has a top 24, a side 25 and a bottom 26, as shown in FIG. 1. The net supporting device comprises a roller 27 rotatably mounted in the hole 22 in the member 1 (FIG. 1). A length of cord 28 (FIG. 1) passes around part of the roller 27 in a manner whereby a first part 29 of the cord extends in spaced substantially parallel relation with the member 1 between said member and the length of chain 14 and a second part 30 of said cord extends substantially perpendicularly with said member, for supporting the net 23, at the top 24 of said net, as shown in FIG. 1. The cord 28 is preferably Nylon and passes through the binding at the top 24 of the net 23, as shown in FIG. 1.

The net supporting device further comprises a length 31 of elastic material of any suitable type such as, for example, rubber or rubberized material, having a top end 32, releasably coupled to the first part 29 of the cord 28 via a hook 33, and a spaced opposite bottom end 34, releasably coupled to the free end 21 of the lower arm 20 via a hook 35, as shown in FIG. 1. The net supporting device functions to maintain tension on the net 23 supported by the cord 28 and said net is lowerable along the member 1 without damaging the pole or net. The net 23 may be lowered as much as three or four feet without damage to the pole or net.

Additional lengths of elastic material 36, 37, 38, 39, and so on, are preferably provided, as shown in FIG. 3. A plurality of hooks 40, 41, 42, 43, and so on, are utilized to releasably couple the lengths of elastic material 36, 37, 38, 39, and so on, to form an elongated length of said material, as shown in FIG. 3. Thus, as shown in FIG. 3, the hook 40 releasably couples the lengths of elastic material 31 and 36 to each other, the hook 41 releasably couples the lengths of elastic material 36 and 37 to each other, the hook 42 releasably couples the lengths of elastic material 37 and 38 to each other and the hook 43 releasably couples the lengths of elastic material 38 and 39 to each other.

A second cord 44 maintains the net 23 in position, as shown in FIG. 1. The second cord 44 has a first end 45 tied to the length of chain 14 at a point 46 between the ends 15 and 16 of said length of chain and a second end 47 for tying to the bottom 26 of the net 23 at the side 25 thereof, as shown in FIG. 1.

A third cord 48 also maintains the net 23 in position, as shown in FIG. 1. The third cord 48 has a first end 49 tied to the length of chain 14 near the top end 16 thereof and a second end 50 for tying to the side 25 of the net 23 at a point 51, intermediate the top 24 and bottom 26 of said net.

While the invention has been described by means of a specific example and in a specific embodiment, I do not wish to be limited thereto, for obvious modifications will occur to those skilled in the art without departing from the spirit and scope of the invention.

I claim:

1. A pole structure for supporting a net of a field game, said pole structure comprising an elongated substantially linearly extending member having spaced opposite top and bottom ends;

mounting means for supporting said elongated member at its bottom end substantially vertically in the ground;

a length of chain having a bottom end coupled to said mounting means, a spaced opposite top end coupled to said elongated member in the area of the top end of said member in a manner whereby said length of chain extends substantially parallel with said member in spaced relation therewith and tension adjusting means coupled therein intermediate said ends in a manner whereby said chain functions as an adjustable strut to maintain said member in substantially vertical position; and net supporting means for supporting a net in the area of the top end of said elongated member and substantially perpendicularly to said member, said net supporting means comprising a roller rotatably mounted on said member closely adjacent the top end thereof, a length of cord passing around part of said roller in a manner whereby a first part of the cord extends in spaced substantially parallel relation with said elongated member between said member and said length of chain and a second part of said cord extends substantially perpendicularly with said member for supporting a net at the top of the net and a length of elastic material having a top end coupled to the first part of said cord and a spaced opposite bottom end coupled to said elongated member in the area of the bottom end thereof whereby tension is maintained on a net supported by said cord and said net is lowerable along said elongated member.

2. A pole structure as claimed in claim 1, wherein said mounting means comprises a block seated in a hole in the ground and having an upper surface substantially level with the surface of the ground, said block having a substantially vertically extending channel formed therethrough and accommodating the bottom end part of said elongated member and a hook device mounted on said upper surface in spaced relation with said channel for releasably coupling the bottom end of said length of chain to said block.

3. A pole structure as claimed in claim 2, further comprising an annular plate around said elongated member in close proximity with said upper surface of said block and a collar of waterproof material around said elongated member at said upper surface of said block and next-adjacent said plate and covering said channel thereby preventing liquid from entering said channel.

4. A pole structure as claimed in claim 2, wherein said tension adjusting means comprises a turnbuckle, and further comprising an upper arm extending from said elongated member in the area of the top end thereof and having a free end spaced from said elongated member, the top end of said length of chain being coupled to the free end of said upper arm.

5. A pole structure as claimed in claim 2, wherein said elongated member has a substantially square cross-section and the channel of said block is of substantially square cross-section.

6. A pole structure as claimed in claim 4, further comprising a lower arm extending from said elongated member in the area of the bottom end thereof and having a free end spaced from said elongated member, the bottom end of said length of elastic material being releasably coupled to the free end of said lower arm, and wherein said elongated member has a hole formed therethrough extending transversely thereof closely adjacent the top end thereof and said roller is rotatably mounted in said hole.

7. A pole structure as claimed in claim 4, further comprising additional lengths of elastic material and a plurality of hook devices releasably coupling the lengths of elastic material to form an elongated length of said material.

8. A pole structure as claimed in claim 4, further comprising a second cord for maintaining a net in position, said second cord having a first end tied to said length of chain at a point between the ends thereof and a second end for tying to the bottom of a net and a third cord for maintaining the net in position, said third cord having a first end tied to said length of chain near the top end thereof and a second end for tying to the net at a point intermediate the top and bottom thereof.

* * * * *